United States Patent [19]

Francis

[11] 4,030,200

[45] June 21, 1977

[54] PORTABLE SEWING ALIGNING TABLE SYSTEM

[76] Inventor: Jane S. Francis, 3900 Allendale Court, Monkton, Md. 21111

[22] Filed: Nov. 21, 1975

[21] Appl. No.: 634,267

[52] U.S. Cl. ..... 33/76 R; 33/11

[51] Int. Cl.[2] ..... B43L 5/00

[58] Field of Search ..... 33/2 R, 11, 16, 17 R, 33/76 R, 80, 13; 108/34; 248/201, 204, 251, 262, 264, 268, 300

[56] References Cited

UNITED STATES PATENTS

| | | | |
|---|---|---|---|
| 430,059 | 6/1890 | Baughman et al. | 33/13 |
| 714,545 | 11/1902 | Whitehouse | 33/80 |
| 1,072,908 | 9/1913 | Buda | 33/16 |
| 1,436,415 | 11/1922 | Sullivan et al. | 33/80 |
| 1,443,998 | 2/1923 | Meltzer | 33/80 |
| 1,736,342 | 11/1929 | Giehler | 33/76 R |
| 1,838,320 | 12/1931 | Moore | 248/268 X |
| 2,470,318 | 5/1949 | Nadelson | 248/204 X |
| 2,588,405 | 3/1952 | Munger | 108/34 |
| 2,652,300 | 9/1953 | Graber et al. | 108/34 |
| 2,713,204 | 7/1955 | Moore | 33/16 |

FOREIGN PATENTS OR APPLICATIONS

| | | | |
|---|---|---|---|
| 4,508 | 2/1911 | United Kingdom | 248/201 |

*Primary Examiner*—Charles E. Phillips
*Attorney, Agent, or Firm*—John F. McClellan, Sr.

[57] ABSTRACT

A portable folding table system especially adapted for support on a bed, which folds for storage and which when open provides aligning, work supporting and work ventilating facilities; a grid on the table surface supplies means for squaring the weave of cloths being worked on the table, rods on opposed edges of the table parallel with lines of the grid provide guides for a snap-on graduated straight edge slidable on the rods to align patterns placed on the cloth being worked with the weave of the cloth; folding clips with sized holes cramp the rods in the holes to constrain the rods in working position; sliding-bolts maintain the table panels in-plane and detachable legs with large-area feet provide secure, damage-free support on a bed or the like when the table is in use; when folded the table provides capacious, internal storage for the rods, legs, straight edge and other accessories and materials used in sewing; a system of surface perforations coincident with intersections of the grid permits ready drying of cloth articles spread out flat and a tactile indication useful in sewing operations of the location of grid intersections when concealed by cloth.

1 Claim, 2 Drawing Figures

PORTABLE SEWING ALIGNING TABLE SYSTEM

This invention relates generally to horizontal work supports and specifically to layout and work holding tables used in sewing.

A principal object of the invention is to provide a self-storing portable sewing table in the form of a folding table with layout apparatus, which utilizes household space not otherwise conveniently available for sewing operations.

In the prior art, various work layout and work support tables and folding tables have been disclosed.

Included among the prior art references are the following U.S. Pat. Nos. 2,713,204 granted to D. L. Moore on July 19, 1955, disclosing a T shaped member with a transverse bridge for aligning goods patterns; 2,588,405 granted to N. W. Munger on Mar. 11, 1952, for a four leaf table with detachable legs which collapse to form two chambers; 714,545 granted to A. T. Whitehouse on Nov. 25, 1902, for a table with rectangular grid markings and a straightedge slidable along a rod; 451,553 granted to G. Drummond on May 5, 1891, for a rectangular grid pattern; U.S. Pat. No. 316,142 granted to N. N. Gordon on 4–21–81 for a folding table with internal leg-storage; 169,744 granted to F. H. Ulrich on Nov. 9, 1875, for slidable straightedges for pattern work. British Pat. No. 15,242 granted to H. V. Gibson on July 2, 1913, likewise discloses slideable straightedges for pattern work.

However, in the prior art, Applicant's unique combination of co-acting features as set forth does not appear to be disclosed.

Further objects of the present invention are to provide a sewing facility as described which is lightweight but rigid and sturdy, convenient and safe to deploy, use and store, simple and easy to learn to use, versatile in operation, economical to manufacture and purchase, durable and fire resistant in the preferred embodiment, which preserves the contents in storage, and which is durable and attractive in appearance both when deployed and folded for storage.

In brief summary given for cursive description purposes only and not as limitation, the invention includes a surface-marked quick-deployment folding table with a straight-edge which can be snapped-on and off on an instant assembly guide at either end of the table for alignment with the surface markings; in the preferred embodiment the table surface has a grid of perforations and the underside has storage for elements of the assembly.

The above and other objects and advantages of this invention will become more apparent from the following description, including the drawings, in which.

In the Figures, like reference numerals refer to like parts.

STRUCTURE AND FEATURES OF THE SYSTEM WHEN SET-UP FOR OPERATION

Figure 1:
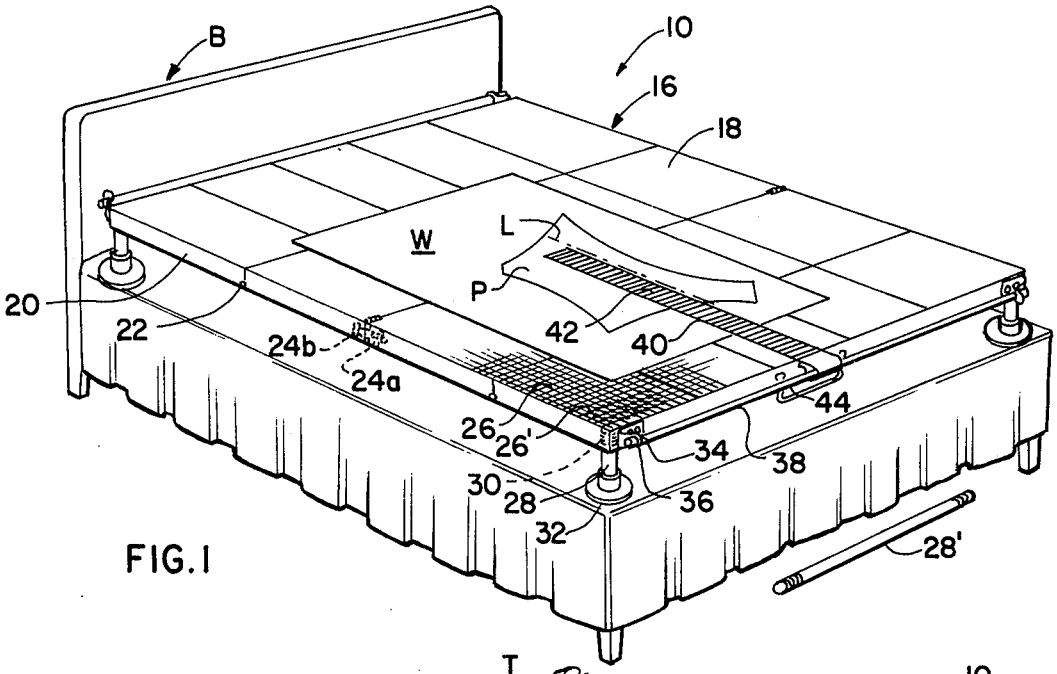
FIG. 1 is an isometric view of the invention deployed and in use.

FIG. 1 shows the invention 10 in use on a bed B. The invention includes a table top 16 made of four panels 18 with respective downward frames 20 closely aligned by hinge connections 22 and maintainable in co-planar relation by sliding bolt assemblies, each of which has a boltway **24*a* and a keep 24*b*** for aligning the bolt.

The table top upper surface bears grid markings 26 or reference indications preferably dividing the surface into one-inch (2.54 cm) squares. At the intersection of the grid lines, perforations 26' through the top are preferably provided. The table top surface structure is preferably of rigid aluminum sheeting about 0.020 inch (0.5mm) thick. The frames may be of the same thickness and bent into flange shape at the bottom edges of the frames for stiffness.

Legs 28, 28', which may be of wood, may friction-fit but preferably screw into sockets 30 in the underside of the table and terminate in broad circular feet 32 of rigid rubber or of rigid plastic such as high density polyethylene. The feet preferably detach for storage.

Leg length for units 28 preferably is about 7 inches (17.5cm) providing a 29 inch (72.5cm) working height, equivalent to that of the usual sewing table, when the unit is set-up on a conventional bed. Length for unit 28' is preferably 29 inches (73.7cm) to permit using the table as such, without a bed. Legs of intermediate length, as from 11 inches to 15 inches (27.9 cm to 38.1 cm) may be provided for adjusting the height to suit individual needs. The legs are preferably threaded permitting coupling end-to-end in the threaded feet 32 for maximum flexibility in height adjustment.

At each end of the table in spaced, facing relation, a pair of spring clips 34 of compressed U shape is provided. One leg is fastened to the table and biases the other leg toward the table. The inwardly biased leg of each clip has a hole 36 sized substantially to fit a rod 38. Together each facing pair of clips receives a rod 38 and detachably affixes the rod to the table parallel with the table ends by cramping the rod in the holes under spring tension. The rod preferably is of uniform circular cross-section aluminum or the like making set-up very simple, decreasing cost of manufacture, and permitting free-swinging of the straightedge circumferentially about the rod.

It can be seen that axial movement of the rod in one direction will be prevented by the clip which slopes in that direction, and similarly in the other direction by the clip which slopes in the other direction, in the manner of transomrod clamping.

A straightedge 40 of flat strip such as rigid polystyrene and having transverse graduations 42, preferably on one inch centers as well as minor graduations on one-eighth inch centers, detachably clips on the rod at either end of the table as desired by means of a curved end on the flat strip having in profile a shepherd's crook with an outward recurve 44 facilitating snapping the straightedge onto the rod when setting up the system or when changing ends.

The circular portion of the curved-end elastically fits the rod, so that the flat strip maintains a right-angle relation to the rod when the flat strip is slid along the rod from one position to another. The length of the straightedge is greater than one-half the length of the table so that by using it on the rods in turn the entire length of the table can be reached. The straightedges length is less than the panel diagonal-dimension and preferably less than the width of the table, so that it can easily be fastened beneath the table when the table is folded for storage.

When the straightedge is in working position on either rod the straightedge major graduations coincide with corresponding markings on the table, making alignment easier when a workpiece is on the table.

OPERATION AND FURTHER FEATURES WHEN SET-UP

In operation, a workpiece W of cloth or similar material is placed on the table surface with the weave or grain in alignment with the grid markings. Any desired pattern P to be used in defining an intended outline is then generally positioned on the workpiece. Finally, the straightedge 40 is slid over the pattern, guided by one of the rods 38, and the directional line L characteristically imprinted on patterns is oriented to coincide with the straightedge, thus aligning the grain of the material with the pattern directional line and both with the table, grid markings, and straightedge.

It is apparent that the perforations can be used as reference indications in the aligning process to locate particular positions concealed by the workpiece and pattern, by projecting the alignment in $x$ and $y$ and probing with a pin to determine the perforation location at the desired intersection.

A further major advantage of the perforation system is to provide in conjunction with the table surface a vented non-rusting drying surface on which sweaters or other items requiring drying can be spread out. Wet woolen sweaters and the like, which lose shape when wet and must be restored to shape prior to taking a set on drying, can be aligned with the grid exactly and dried in-place quickly, the heat-conductive aluminum surface tending to maintain the drying articles, at room temperature regardless of evaporative rate during drying.

STORAGE CONFIGURATION AND FEATURES

Figure 2:
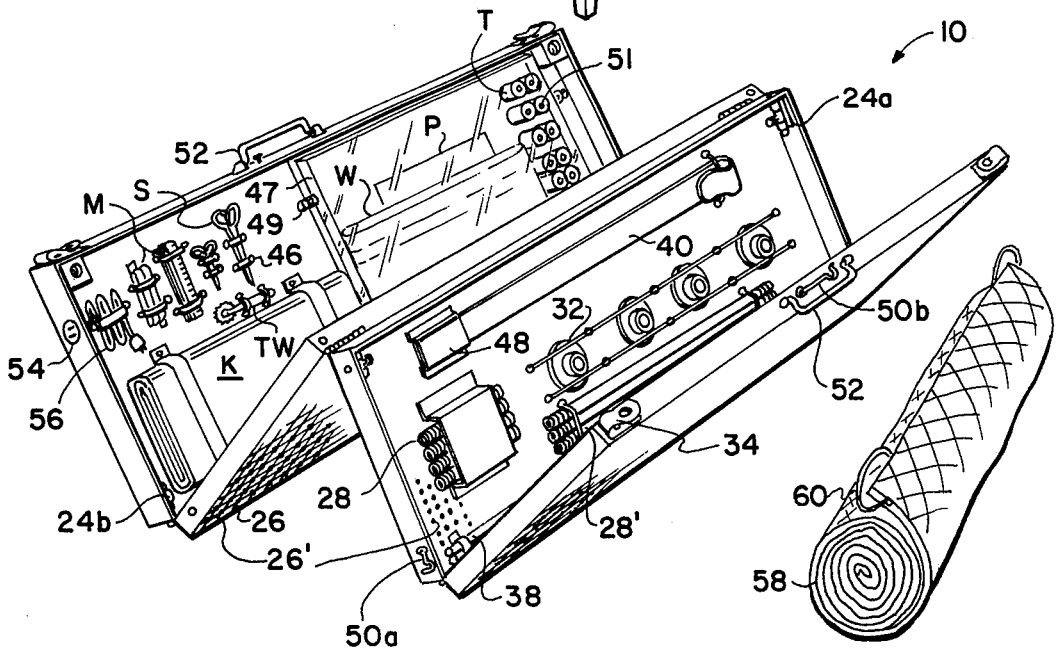
FIG. 2 is an isometric view of the invention inverted and partially deployed as when being unfolded, or when being folded for storage.

FIG. 2 shows the invention 10 inverted and in partially deployed configuration, with the various parts of the assembly stored, together with material being worked W, patterns P, and the like. In the partially deployed position, the panels hinge to form in end profile an M shape, and in the inverted position in end profile a W shape, being preferably equal in width. The undersides of the adjacent panels of each pair of the four form storage compartments when opposed in folding.

Elastic straps 46 may be used to secure scissors S, sewing kit K, and the like. Safe storage of cloth W, thread T, or other fibrous material, and paper patterns P is assured by provision of a large plastic container 47 held detachably by clips 49. Spools of thread are held on pegs 51 attached within the container. Ventilation through the perforations, it is evident, better adapts the unit for storage beneath beds, in isolated closets, or in similar locations. Measuring devices M such as folding ruler, tapes, and also tracing wheels TW and the like are conveniently similarly stored.

Elastic straps also secure the legs 28, feet 32, and rods 38 in place beneath the table surface for storage. The straightedge 40 fits into a storage socket 48 at one end and is secured by an elastic strap at the other. Snap fasteners may be used at the ends of the straps if desired, and may be welded or cemented or flush riveted to the table structure.

Latches 50*a*, 50*b* may be used to hold the unit shut when in storage and carrying handles 52 are preferably provided. When being deployed, the unit can be stood on edge for leg assembly and bolt sliding to fix the panels in plane. When standing on the legs, the unit provides ample space for reaching beneath to obtain scissors and the like, and the perforations aid in noting the position of such items from above. The perforations also reduce weight so that manipulating the structure is made easier.

The rod fasteners or spring clips 34 safely spring substantially flat when not in use, but can be instantly affixed to the rods when desired by being manually sprung open and having the respective rod ends inserted. A convenience outlet 54 for electric scissors may be provided in the edge of the table, and may have an integral extension cord 56 clipped beneath the table when in storage. Finally, an ironing pad 58 with corner ties or elastic 60 is preferably provided to adapt the unit as a very convenient oversize perforate ironing board.

In summary, the invention provides with simplicity and at low cost, a portable sewing table, not only making set-up and lay-out easy and fast and utilizing space normally unavailable for working, but also providing a superior drying and storage unit.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for use in laying out, sewing and storing cloth and the like, comprising: a table having a top, said table top having first and second ends and downward frame structure thereon, hinge means adjacent said frame structure for folding the table into storage-case configuration, the table top having a grid marking over the upper surface thereof with a plurality of holes through the table top in regular pattern at respective intersections of the grid marking, a straightedge, means including a rod for securing the straightedge detachably and slidably and pivotally at either end of the table in alignment with the grid markings such that the straight-edge can slide along said rod and the table top and can pivot about said rod to a position where the straight edge is not on said table top, means for holding the rod at each end of the table comprising a respective pair of flat-spring U-shaped clips fixed in spaced relation on said first and second ends with one leg of the U attached to said ends and the other leg of the U having a respective hole sized to fit said rod, the respective spring clips of each pair oppositely self-biasing flat at the table for storage and resiliently cramping the rod when the rod is inserted in said holes for holding, said means for securing including a shepherd's crook hook on the straight edge for quick engagement and disengagement with the rod, said straightedge having a plurality of transverse markings located for coincidence with the grid and holes through the table top when the rod is holding the straightedge.

* * * * *